United States Patent [19]

Taniguchi et al.

[11] Patent Number: 4,841,922

[45] Date of Patent: Jun. 27, 1989

[54] METHOD OF MAKING A ROCKER ARM

[75] Inventors: Masato Taniguchi; Mitsuyoshi Kawamura; Noboru Ishida; Masaya Ito, all of Nagoya, Japan

[73] Assignee: NGK Spark Plug Co., Ltd., Nagoya, Japan

[21] Appl. No.: 273,622

[22] Filed: Nov. 17, 1988

Related U.S. Application Data

[63] Continuation of Ser. No. 21,859, Mar. 4, 1987, abandoned.

[30] Foreign Application Priority Data

Mar. 6, 1986 [JP] Japan ..... 61-47188

[51] Int. Cl.[4] ..... F01L 1/18

[52] U.S. Cl. ..... 123/90.51; 123/90.39; 123/90.44; 29/156.7 R

[58] Field of Search ..... 123/90.51, 90.39, 90.41, 123/90.45, 90.43, 90.49, 90.44; 74/559; 29/156.7 R; 164/80

[56] References Cited

U.S. PATENT DOCUMENTS

| | | | |
|---|---|---|---|
| 2,648,235 | 4/1953 | Leake | 123/90.39 |
| 3,255,513 | 6/1966 | Robinson et al. | 29/156.7 R |
| 3,319,321 | 5/1967 | Danis | 29/156.7 R |
| 3,502,058 | 3/1970 | Thompson | 123/90.43 |
| 3,563,216 | 2/1971 | Uemura | 74/559 |
| 3,672,338 | 6/1972 | Yamanouchi | 123/90.43 |
| 4,548,253 | 10/1985 | Futvatani et al. | 164/80 |
| 4,598,675 | 7/1986 | Long | 123/90.51 |
| 4,617,883 | 10/1986 | Okuyama et al. | 123/90.39 |
| 4,658,770 | 4/1987 | Okuyama et al. | 123/90.43 |

*Primary Examiner*—Willis R. Wolfe
*Assistant Examiner*—M. Macy
*Attorney, Agent, or Firm*—Foley & Lardner, Schwartz, Jeffery, Schwaab, Mack, Blumenthal & Evans

[57] ABSTRACT

A rocker arm comprises an arm section extending throughout the overall length thereof. The arm section is made of ceramics and adapted to engage a cam, valve stem and a lash adjuster.

2 Claims, 2 Drawing Sheets

METHOD OF MAKING A ROCKER ARM

This application is a continuation, of application Ser. No. 021,859, filed Mar. 4, 1987, now abandoned.

BACKGROUND OF THE INVENTION

1. Field of the Invention

The present invention relates to rocker arms for internal combustion engines, particularly of the kind having a portion made of ceramics in order to attain good wear resistibility.

2. Description of the Prior Art

A rocker arm partly made of ceramics is known in the art and has been used in some LPG engine equipped vehicles. In such a rocker arm, only a portion for contact with a cam is made of ceramics so as to efficiently improve the wear resistibility. Use of ceramics in the prior art rocker arm is therefore directed to the durability, reliability, maintenance, etc. of the engine and has no direct relation to the engine performance such as engine power, etc.

SUMMARY OF THE INVENTION

In accordance with the present invention, there is provided a rocker arm which comprises an arm section extending throughout the overall length of the rocker arm and having a portion for engagement with the cam and a portion for engagement with the valve, the arm section being made of ceramics.

The above structure is effective not only for improving the wear resistibility but also for improving the engine performance.

It is accordingly an object of the present invention to provide a novel and improved rocker arm for a internal combustion engine which can improve the engine performance as well as the wear resistibility.

DETAILED DESCRIPTION OF THE PREFERRED EMBODIMENTS

Figure 1:
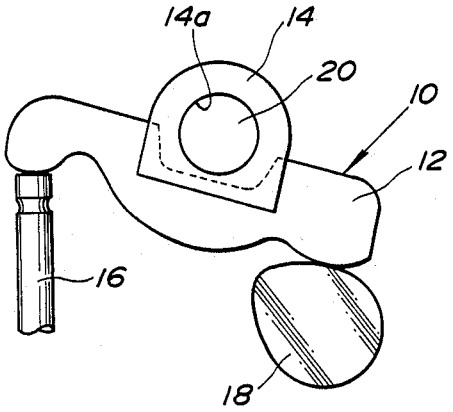
FIG. 1 is a schematic elevational view of a valve operating mechanism for an internal combustion engine, to which a rocker arm according to an embodiment of the present invention is applied.

Referring first to FIG. 1, a rocker arm according to an embodiment of the present invention is generally indicated by 10 and shown as being constituted by an arm section 12 made of ceramics and a bearing section or pivot section 14 made of an aluminium alloy. The arm section 12 extends between an end of a valve stem 16 and a cam 18 to engage the same at the opposite ends thereof. The pivot section 14 is formed with a bore 14*a* in which a journal section of a rocker shaft 20 is rotatably received, i.e., the rocker arm 10 is mounted at the pivot section 14 on the rocker shaft 20 for oscillation.

More specifically, the arm section 12 has vertically opposed upper and lower sides and is adapted to engage at the lower side with the end of the valve stem 16 and the cam 18 and to install at the upper side the pivot section 14. The pivot section 14 is positioned between the opposite ends of the arm section 12, i.e., the rocker shaft 20 is positioned between the end of the valve stem 16 and the cam 18.

With the above structure, the rocker arm 10 can be lighter in weight and larger in mechanical strength as compared with the aforementioned prior art rocker arm partly made of ceramics. By this, the inertia mass of the rocker arm 10 can be smaller than that of the prior art rocker arm.

Figure 2:
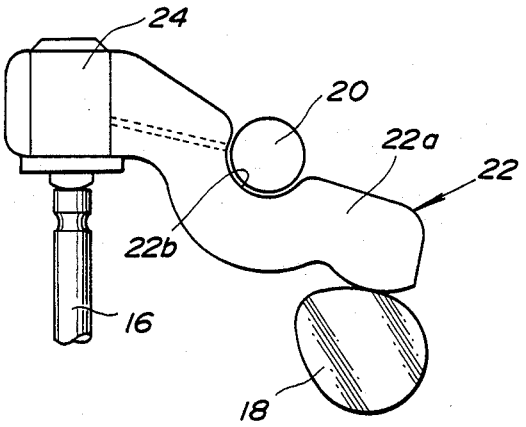
FIGS. 2 and 4 are views similar to FIG. 1 but showing modifications of the present invention.

FIG. 2 shows a modification of the present invention. By this modification, the rocker arm 22 is entirely made of ceramics, i.e., the rocker arm 22 is constituted by the ceramic arm section 22*a* only. The arm section 22*a* is formed with a bearing or pivot portion 22b in the form of a part-cylindrical depression on the upper side thereof. The arm section 22*a* is adapted to install at an end thereof a lash adjuster 24 by way of which the rocker arm 22 is put into contact with the end of the valve stem 16. Except for the above, this embodiment is substantially similar to the previous embodiment.

Figure 3:
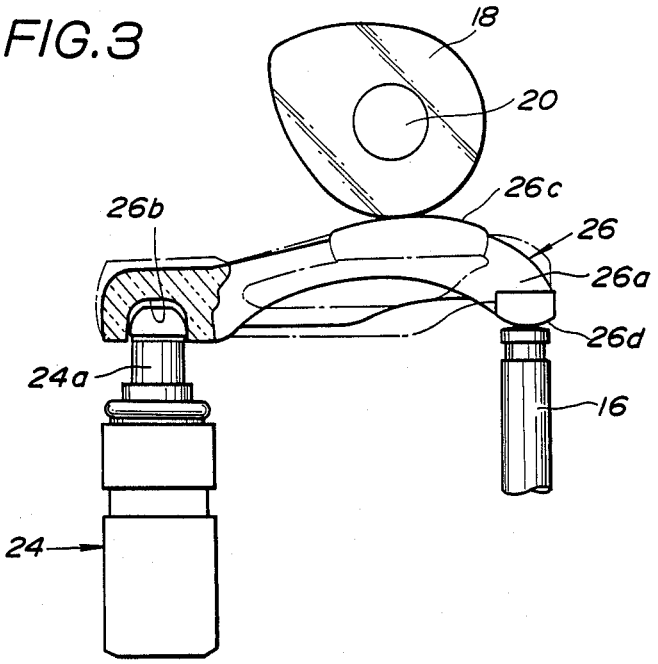

FIG. 3 shows a further modification of the present invention. By this modification, the rocker arm 26 is entirely made of ceramics, i.e., made of nitride silicon by injection molding, and formed into a shape different from that of the rocker arms 10, 22 of the previous embodiments of FIGS. 1 and 2. In other words, the rocker arm 26 is constituted by a ceramic arm section 26*a* only. The arm section 26*a* has at an end a depression 26*b* for receiving therein an end of a pivot 24*a* of a lash adjuster 24 so as to oscillate about the pivot 24*a*. The arm section 26*a* also has on the upper side thereof and in the place intermediate between the opposite ends thereof a portion 26*c* for contact with the cam 18, i.e., the cam 18 is positioned between the lash adjuster 22 and the valve stem 16.

The all ceramic rocker arm 26 of this embodiment is produced by injection molding and then processed by barrel finishing. After that, the portion 26*b* of the rocker arm 26 for contact with the pivot 24*a* of the lash adjuster 24 is ground by using the valve contacting portion 26*d* and the cam contacting portion 26*c* as reference or datum surfaces. By this method, only the contact portion 26*b* needs to be ground actually, thus making it possible to simplify the manufacturing processes of the rocker arm 26.

In FIG. 3, indicated by the one-dot-chain line is the shape of the comparable prior art rocker arm made of metal. As will be seen from the comparison between the two shapes in FIG. 3, the all ceramic rocker arm 26 of this invention can be thinner or more slender than the metal rocker arm and therefore can be considerably lighter in weight while providing a good wear resistibility particularly at the portions for contact with the lash adjuster 22 and the valve stem 16.

Since the rocker arm 26 can be thinner than the comparable prior art metal rocker arm, it becomes possible to reduce the weight as much as 20%. In the meantime, by the performance test of a 2-liter four cylinder gasoline engine which is provided with the rocker arms 26 of this invention together with all ceramic valves, it was found that the fuel consumption during idling is improved as much as 5% and the maximum rpm becomes higher as much as 5% as compared with the engine provided with the rocker arms of the aforementioned partly ceramic type.

Figure 4:
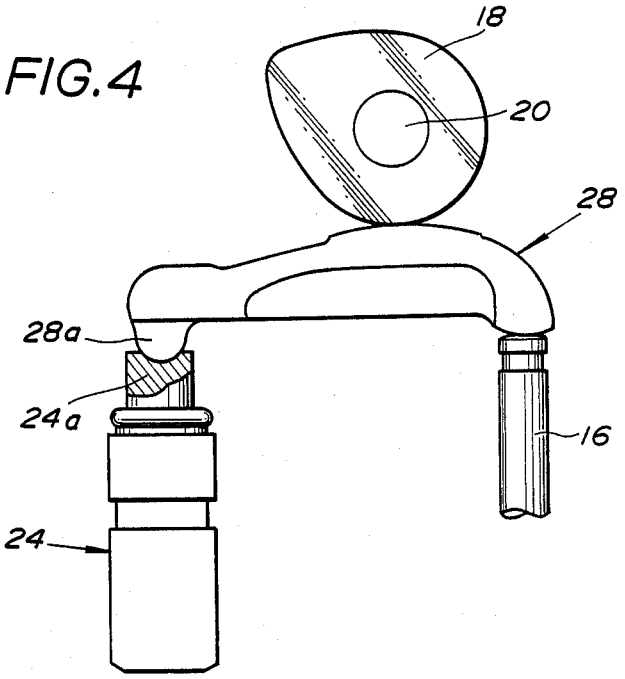

FIG. 4 shows a further modification of the present invention. The rocker arm 28 has at an end thereof a semispherical projection 28*a* for contact with the recessed end of the pivot 24*a* of the lash adjuster 24. Except for the above, this embodiment is substantially similar to the previous embodiment of FIG. 3.

From the foregoing, it is to be understood that the maintenance can be improved considerably since the portions of the rocker arm for contact with the associated parts are made of ceramics which has an excellent wear resistibility.

It is further to be understood that by the use of ceramics in the foregoing manner the rocker arm of this invention has a large Young's modulus and is thus superior in rigidly to the aforementioned prior art rocker arm.

It is still further to be understood that the rocker arm of this invention can be thinner and lighter than the prior art rocker arm since the rocker arm of this invention is larger in rated strength (i.e., ratio of strength to weight) than the prior art rocker arm which is mainly made of metal, resulting in that the rocker arm of this invention can follow the operation of the cam more efficiently and accurately than the prior art rocker arm and therefore the engine can be operated at a speed higher than ever, i.e., the maximum speed of the engine can be set larger than ever.

It is yet further to be understood that the rocker arm of this invention can contribute to improvements in the engine performance particularly when used together with the ceramic valves since the weight of the ceramic valve can be less than half of that of the metal valve and therefore the ceramic valve is all the more affected adversely or unfavorably by the metal rocker arm or rocker arm mainly made of metal due to its large inertia mass.

What is claimed is:

1. A method of producing a rocker arm, comprising:

forming a rocker arm having a valve contacting portion, a cam contacting portion and a pivot portion for contact with a pivot of a lash adjuster and entirely made of ceramics;

processing said rocker arm by barrel finishing; and;

grinding said pivot portion by using said valve contacting portion and said cam contacting portion as datum surfaces and thereby locating said pivot portion in position relative to said valve contacting portion and said cam contacting portion.

2. A method of producing an all ceramic rocker arm having a valve contacting portion at an end, a pivot portion for contact with a pivot of a lash adjuster at the other end and a cam contacting portion between the pivot portion and the valve contacting portion, the valve contacting portion and the pivot portion being located on the same side and the cam contacting portion being located on the opposite side, said method comprising:

forming said rocker arm;

processing said rocker arm by barrel finishing; and grinding said pivot portion by using said valve contacting portion and said cam contacting portion as reference surfaces and thereby positioning said pivot portion accurately in place relative to said valve contacting portion and said cam contacting portion.

* * * * *